US005175520A

United States Patent [19]

Inoue

[11] Patent Number: 5,175,520

[45] Date of Patent: Dec. 29, 1992

[54] HIGH FREQUENCY COAXIAL RESONATOR

[75] Inventor: Atsushi Inoue, Kyoto, Japan

[73] Assignee: Murata Manufacturing Co., Ltd., Japan

[21] Appl. No.: 547,919

[22] Filed: Jul. 3, 1990

[30] Foreign Application Priority Data

Jul. 4, 1989 [JP] Japan ..... 1-173263

[51] Int. Cl.[5] ..... H01P 7/04

[52] U.S. Cl. ..... 333/222; 333/223

[58] Field of Search ..... 333/202, 203, 206, 207, 333/219.1, 222, 223, 235

[56] References Cited

U.S. PATENT DOCUMENTS

| | | | |
|---|---|---|---|
| 4,431,977 | 2/1984 | Sokola et al. | 333/206 |
| 4,523,162 | 6/1985 | Johnson | 333/203 X |
| 4,757,284 | 7/1988 | Ueno | 333/203 |
| 4,800,348 | 1/1989 | Rosar et al. | 333/222 X |
| 4,837,534 | 6/1989 | Van Horn | 333/223 X |

FOREIGN PATENT DOCUMENTS

| | | | |
|---|---|---|---|
| 0204602 | 11/1983 | Japan | 333/219.1 |
| 0142401 | 6/1987 | Japan | 333/222 |
| 0033904 | 2/1988 | Japan | 333/222 |

*Primary Examiner*—Paul M. Dzierzynski
*Assistant Examiner*—Seung Ham
*Attorney, Agent, or Firm*—Ostrolenk, Faber, Gerb & Soffen

[57] ABSTRACT

A high-frequency coaxial resonator including a tubular dielectric member having a through hole and provided with inner and outer peripheral surfaces and a pair of end surfaces which axially oppose each other. An inner conductor is formed on the inner peripheral surface and an outer conductor is formed on the outer peripheral surface, the outer conductor extending onto one or both end surfaces of the tubular dielectric member so as to approach the inner conductor through a prescribed clearance, thereby forming a capacitance between the inner and outer conductors for adjusting the resonant frequency of the resonator.

27 Claims, 5 Drawing Sheets

HIGH FREQUENCY COAXIAL RESONATOR

BACKGROUND OF THE INVENTION

1. Field of the Invention

The present invention relates to a high-frequency coaxial resonator, which comprises a tubular dielectric member having a through hole and inner and outer conductors provided on inner and outer peripheral surfaces of the tubular dielectric member.

2. Description of the Background Art

FIGS. 9 and 10 illustrate the structures of conventional high-frequency coaxial resonators of the aforementioned type. A high-frequency coaxial resonator 30 shown in FIG. 9 comprises a tubular dielectric member 32 having a through hole 31 and inner and outer conductors 33 and 34 which are provided on inner and outer peripheral surfaces of the tubular dielectric member 32, respectively. The inner and outer conductors 33 and 34 are short-circuited by an end conductor 35 which is formed on one end surface of the high-frequency coaxial resonator 30 so as to define a high-frequency coaxial resonator of a quarter wavelength type.

Alternatively, a conventional high-frequency coaxial resonator 36 shown in FIG. 10 comprises a tubular dielectric member 38 having a through hole 37 and inner and outer conductors 39 and 40 which are provided on inner and outer peripheral surfaces of the tubular dielectric member 38, respectively, so as to define a high-frequency coaxial resonator of a half wave type.

Each of these high-frequency coaxial resonators 30 and 36 is equivalent to an LC parallel resonance circuit. In use, the inner conductor 33 or 39 is connected to a signal-carrying pattern on a circuit board through a central conductor (not shown) which is inserted in the through hole 31 or 37 while the outer conductor 34 or 40 is connected to a ground point provided on the circuit board.

In the high-frequency coaxial resonators 30 and 36 having the aforementioned structures, however, one or both end surfaces are open-ended, thereby exposing the dielectric members 32 and 38, and hence unwanted interference can take place between the open-ended surfaces and external circuits if said external circuits are provided in proximity to the high-frequency coaxial resonators 30 and 36. Therefore, the high-frequency coaxial resonators 30 and 36 must appropriately be spaced apart from external circuits, which thereby hinders in high-density packaging of circuit boards.

Furthermore, since the resonant frequencies of respective sampler of the high-frequency coaxial resonators 30 and 36 having the aforementioned structures are dispersed during the manufacturing steps, the tubular dielectric members 32 and 38 are initially prepared in excess of the prescribed lengths, so that the resonant frequencies thereof are lower than prescribed values, and thereafter are reduced in length by polishing the end surfaces thereof or the like, to increase the resonance frequencies to prescribed values. Thus, the procedure for adjusting the resonant frequencies is extremely complicated.

SUMMARY OF THE INVENTION

The present invention has been proposed in consideration of such problems, and an object thereof is to provide a high-frequency coaxial resonator which enables high-density packaging of a circuit board and a simple procedure for adjusting the resonant frequency.

In order to attain this objective, the inventive high-frequency coaxial resonator is characterized in that at least an outer conductor is extended onto one or both end surfaces of a tubular dielectric member so that the outer conductor approaches an inner conductor across a prescribed clearance, thereby forming a prescribed capacitance between the inner and outer conductors.

According to the present invention, said capacitance formed between said inner and outer conductors at an end surface of said tubular dielectric member is connected in parallel with the equivalent LC parallel resonant circuit formed without such capacitance as is normally formed by said tubular dielectric member, so as to reduce the resonance frequency of a high-frequency coaxial resonator. Thus, it is possible to adjust the resonance frequency of said high-frequency coaxial resonator to a prescribed value by reducing said length of the tubular dielectric member, as compared with a prescribed length, so that the resonance frequency exceeds the prescribed value, and adjusting the clearance width between the inner and outer conductors at said end surface for setting the capacitance formed therebetween to a proper value. Therefore, it is not necessary to adjust the total length of the tubular dielectric member as in the conventional case, and the procedure to adjust the resonance frequency is simplified.

Since the capacitance is adapted to reduce the resonance frequency, it becomes necessary to reduce the length of said tubular dielectric member to increase the resonance frequency, whereby the size of the overall device can be further reduced.

Further, since the resonance frequency can be adjusted by the capacitance, it is possible to provide high-frequency coaxial resonators having different resonance frequencies using tubular dielectric members of the same dimensions.

Furthermore, according to the present invention, one or both end surfaces of said tubular dielectric member are covered with an outer conductor for use as a ground potential, whereby substantially no interference takes place between a device and an external circuit, said circuit not needing be spaced apart from said device, thereby enabling high-density packaging on a circuit board.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
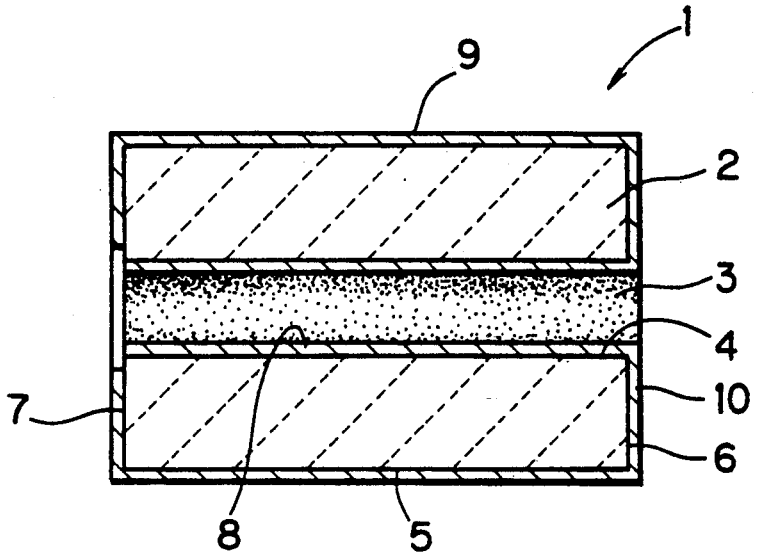
FIG. 1 is a cross-sectional view showing a high-frequency coaxial resonator according to a first embodiment of the present invention.
Figure 2:
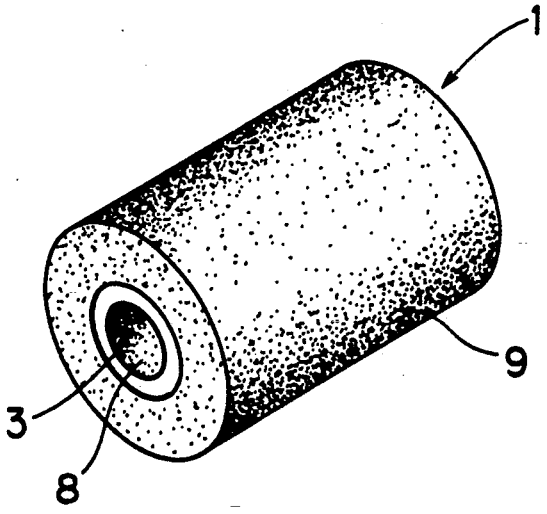
FIG. 2 is a perspective view showing the appearance of the high-frequency coaxial resonator shown in FIG. 1.

FIG. 1 is a sectional view showing a high-frequency coaxial resonator 1 according to one embodiment of the present invention, and FIG. 2 is a perspective view showing the appearance of the high-frequency coaxial resonator 1 in a reduced manner.

Referring to FIGS. 1 and 2, the high-frequency coaxial resonator 1 comprises a tubular dielectric member 2. This tubular dielectric member 2 has a through hole 3 along its central axis, and comprises inner and outer peripheral surfaces 4 and 5 and a pair of end surfaces 6 and 7 which are opposite to each other along the axial direction. The tubular dielectric member 2 is reduced in length as compared with a conventional one, so that its resonance frequency is higher than a prescribed value desired for the resonator.

Inner and outer conductors 8 and 9 are formed entirely over the inner and outer peripheral surfaces 4 and 5 of the tubular dielectric member 2, while an end conductor 10 is formed entirely over one end surface 6. The inner and outer conductors 8 and 9 are short-circuited at the end surface 6 by and conductor 10, to define a high-frequency coaxial resonator of a quarter wavelength type.

The outer conductor 9 is extended onto end surface 7 to a position close to the inner conductor 8, so that a capacitance is formed between the inner and outer conductors 8 and 9 at the end surface 7. This capacitance is adapted to reduce the resonance frequency of the high-frequency coaxial resonator 1. Therefore, although the tubular dielectric member 2 is reduced in length as compared with the conventional one so as to initially increase the resonance frequency, it is possible to adjust the resonance frequency of the high-frequency coaxial resonator 1 to a prescribed value by adjusting a clearance width between the inner and outer conductors 8 and 9 at the end surface 7 thereby setting the capacitance at a prescribed desired value.

Figure 3:
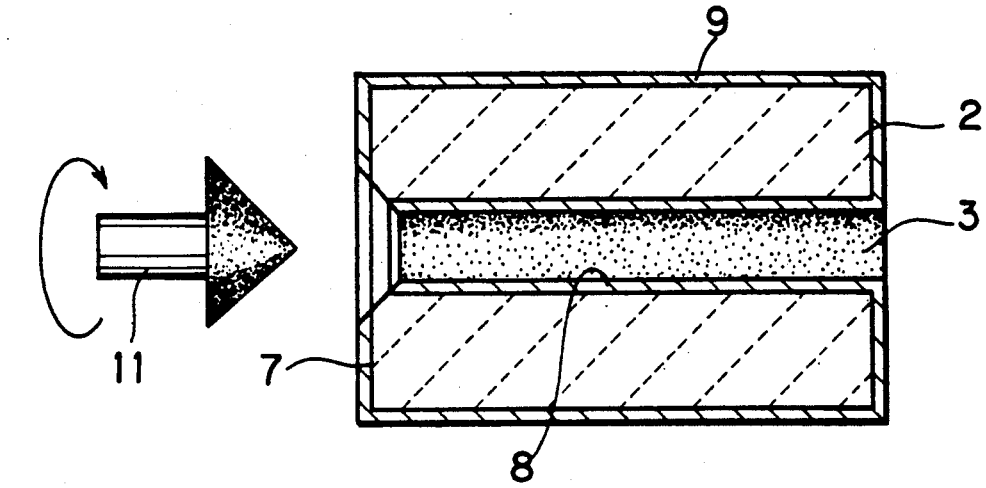
FIG. 3 is a sectional view for illustrating adjusting a clearance width between inner and outer conductors of the high-frequency coaxial resonator shown in FIG. 1.

The clearance width between the inner and outer conductors 8 and 9 may be adjusted by applying a rotating conical cutting tool 11 to a portion of the through hole 3 along the end surface 7 which is substantially entirely provided with the outer conductor 9 and cutting an angular portion along the inner peripheral surface of the tubular dielectric member 2, as shown in FIG. 3, for example.

Figure 4:
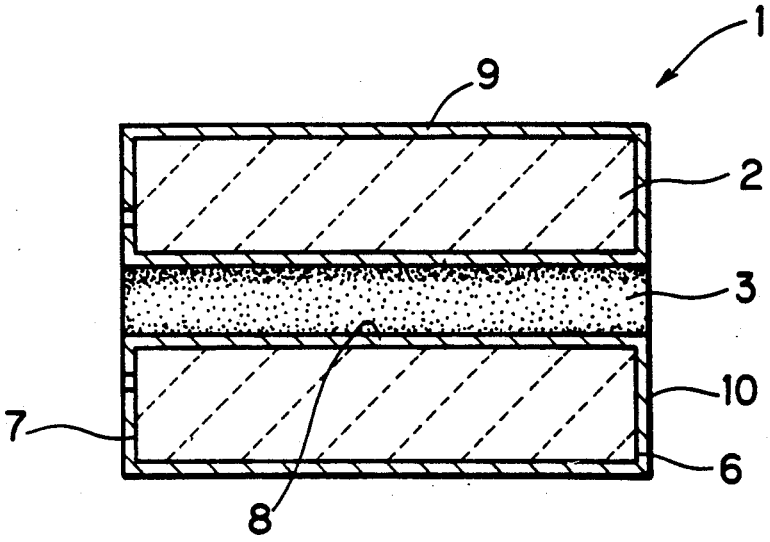
FIGS. 4, 5, 6, 7 and 8 are sectional views respectively showing high-frequency coaxial resonators according to other embodiments of the present invention.

In order to form the capacitance between the inner and outer conductors 8 and 9 at the end surface 7 of the tubular dielectric member 2 according to a second embodiment of the invention, both the inner and outer conductors 8 and 9 may be extended onto the end surface 7, as shown in FIG. 4. Likewise in this embodiment, substantially no interference takes place between the device and an external circuit since the outer conductor 9 partially covers the end surface 7.

Figure 5:
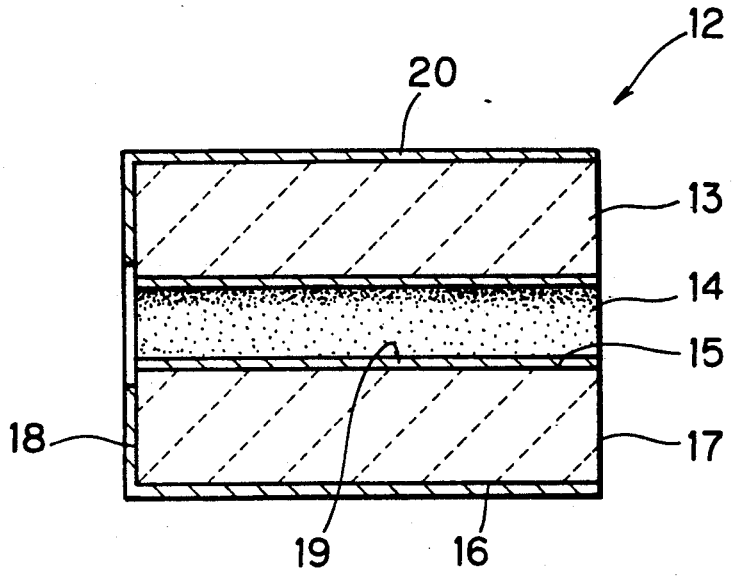

While the above embodiments have related to high-frequency coaxial resonators of a quarter wavelength type, it is also possible to form a high-frequency coaxial resonator of a half wavelength type in a similar manner. FIG. 5 shows such a high-frequency coaxial resonator 12 of a half wavelength type. The high-frequency coaxial resonator 12 comprises a tubular dielectric member 13. The tubular dielectric member 13 has a through hole 14 along its central axis, and comprises inner and outer peripheral surfaces 15 and 16 and a pair of end surfaces 17 and 18 which are opposite to each other along the axial direction. The length of the tubular dielectric member 13 is reduced as compared with the conventional one, so that its resonance frequency is higher than a prescribed value.

Inner and outer conductors 19 and 20 are formed entirely over the inner and outer peripheral surfaces 15 and 16 of the tubular dielectric member 13, respectively. One end surface 17 of the tubular dielectric member 13 is open-ended so as to expose dielectric member 13. The outer conductor 20 is extended onto end surfaces 18 to a position close to the inner conductor 19, so that capacitance is formed between the inner and outer conductors 19 and 20 at the end surface 18. As in the aforementioned embodiment, the capacitance is set at a prescribed value by adjusting a clearance width between the inner and outer conductors 19 and 20 at end surface 18, so that the high-frequency coaxial resonator 12 has a prescribed resonance frequency.

Figure 6:
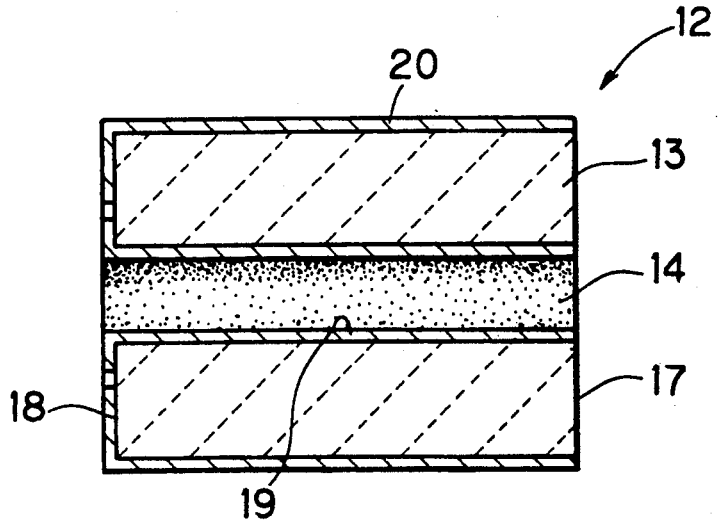
Figure 7:
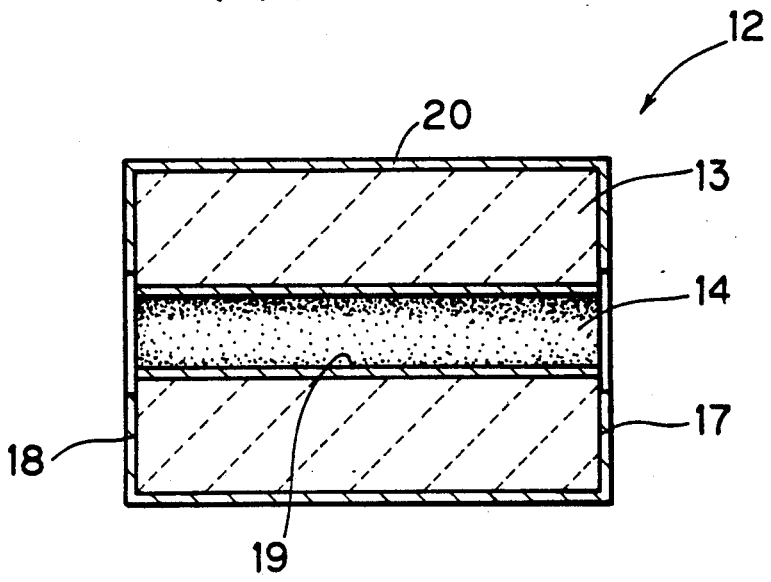
Figure 8:
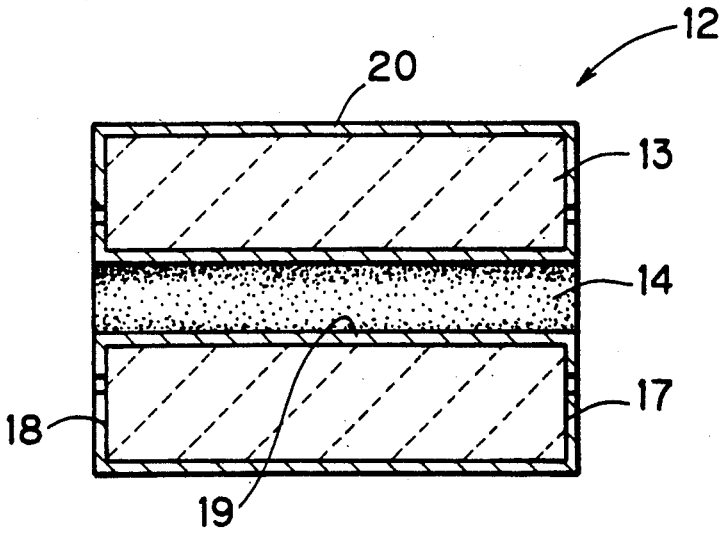
Figure 9:
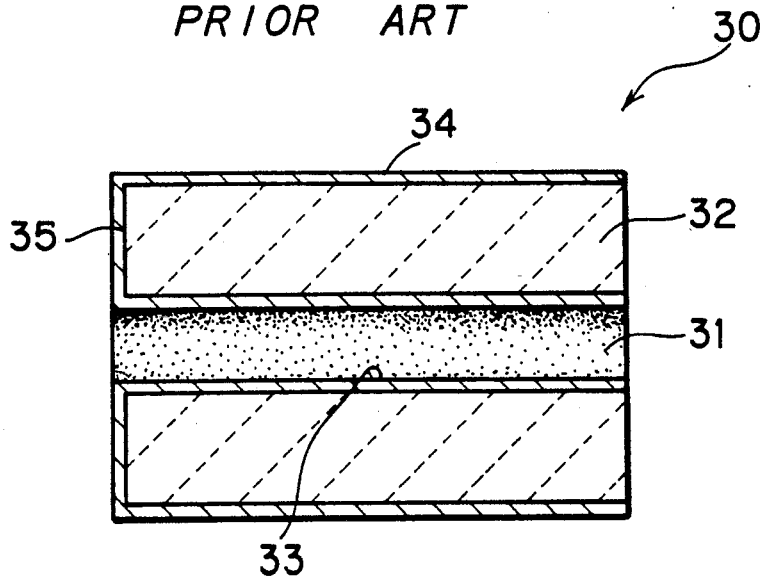
FIG. 9 PRIOR ART
FIGS. 9 and 10 are sectional views showing conventional high-frequency coaxial resonators respectively.
Figure 10:
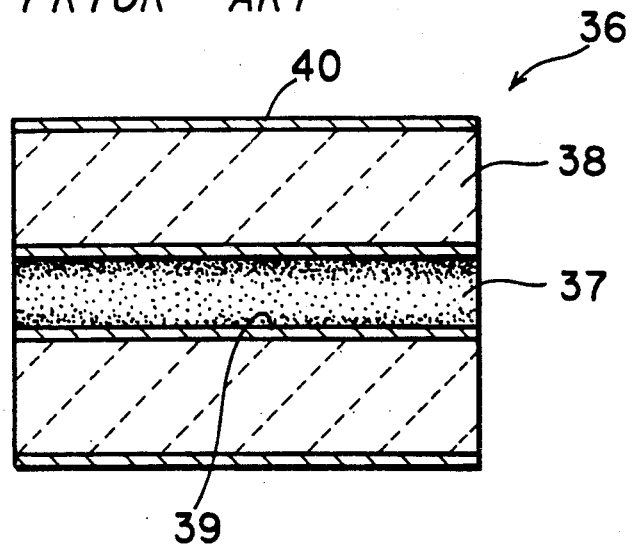
FIG. 10 PRIOR ART

In another embodiment of such a high-frequency coaxial resonator 12, both inner and outer conductors 19 and 20 may be extended on an end surface 18 to form capacitance therebetween, as shown in FIG. 6. In further embodiments of a high-frequency coaxial resonator 12 of the half wavelength type, both outer and inner conductors 20 and 19 or only an outer conductor 20 may be extended onto a first open-ended surface 17, or similarly onto a second open-ended surface 18, as shown in FIG. 7 or 8.

The inner conductors 8 and 19, the outer conductors 9 and 20 and the end conductor 10 are generally formed by applying conductive paste of Ag, Ag-Pd or the like and baking the same in the aforementioned embodiments, or the conductors can be formed by other means such as plating and the line. Further, the tubular dielectric members 2 and 13 can be provided in arbitrary configurations such as cylindrical and angular cylindrical shapes.

Although the present invention has been described and illustrated in detail, it is clearly understood that the same is by way of illustration and example only and is not to be taken by way of limitation, the scope of the present invention being limited only by the terms of the appended claims.

What is claimed is:

1. A method of adjusting the resonance frequency of a high-frequency coaxial resonator to a prescribed value, comprising the steps of:

preparing a dielectric member comprising a member having a tubular cross-section and having a through hole along its central axis and comprising inner and outer peripheral surfaces and a pair of end surfaces opposite each other along the axial direction;

forming an inner conductor on said inner peripheral surface;

forming an outer conductor on said outer peripheral surface;

said tubular dielectric member with said inner and outer conductors initially having a resonance frequency above the prescribed value;

extending said outer conductor from said outer peripheral surface onto at least one of said end surfaces and defining a clearance between an end portion of said inner conductor and said outer conductor thereby forming a capacitance and reducing the resonance frequency below said prescribed value; and adjusting said clearance to obtain a resonance frequency of the prescribed value.

2. A method in accordance with claim 1, wherein said step of forming an inner conductor on said inner peripheral surface includes extending said inner conductor onto at least one of said end surfaces.

3. A method in accordance with claim 2, wherein said step of adjusting said clearance includes a step of increasing said clearance.

4. A method in accordance with claim 1, wherein said step of forming an outer conductor on said outer peripheral surface includes extending said outer conductor onto both end surfaces.

5. A method in accordance with claim 4, wherein said step of adjusting said clearance includes a step of increasing said clearance.

6. A method in accordance with claim 1, wherein said step of forming an inner conductor on said inner peripheral surface includes extending said inner conductor onto both end surfaces.

7. A method in accordance with claim 6, wherein said step of adjusting said clearance includes a step of increasing said clearance.

8. A method in accordance with claim 6, wherein said step of forming an outer conductor on said outer peripheral surface includes extending said outer conductor onto both end surfaces.

9. A method in accordance with claim 1, wherein said step of adjusting said clearance includes a step of increasing said clearance.

10. A method in accordance with claim 4, wherein said step of forming an inner conductor on said inner peripheral surface includes extending said inner conductor onto one end surface.

11. A method in accordance with claim 10, wherein said step of adjusting said clearance includes a step of increasing said clearance.

12. A method of adjusting the resonance frequency of a high-frequency coaxial resonator to a prescribed value, comprising the steps of:

preparing a dielectric member having a tubular cross-section and having a through hole along its central axis and comprising inner and outer peripheral surfaces and a pair of end surfaces opposite each other along the axial direction;

forming an inner conductor on said inner peripheral surface;

forming an outer conductor on said outer peripheral surface;

said tubular dielectric member with said inner and outer conductors initially having a resonance frequency above the prescribed value;

extending said outer conductor from said outer peripheral surface onto at least one of said end surfaces and defining a clearance between an end portion of said inner conductor and said outer conductor to reduce said resonance frequency below the prescribed value; said step of defining comprising providing an angular cut at least through said end portion of said inner conductor, thereby forming a capacitance between said end portion of said inner conductor and said outer conductor extending onto said at least one end surface; and adjusting said clearance to increase the resonance frequency to the prescribed value.

13. A method in accordance with claim 12, wherein said step of defining a clearance further comprises the step of providing said angular cut through said dielectric member and said end portion of said inner conductor.

14. A method in accordance with claim 13, wherein said step of defining a clearance further comprises the step of providing said angular cut through said outer conductor extended onto said at least one end surface.

15. A method in accordance with claim 12, wherein said step of adjusting said clearance includes a step of increasing said clearance.

16. A method in accordance with claim 12, wherein said step of forming an inner conductor on said inner peripheral surface includes extending said inner conductor onto at least one of said end surfaces.

17. A method in accordance with claim 16, wherein said step of adjusting said clearance includes a step of increasing said clearance.

18. A method in accordance with claim 12, wherein said step of forming an outer conductor on said outer peripheral surface includes extending said outer conductor onto both end surfaces.

19. A method in accordance with claim 18, wherein said step of adjusting said clearance includes a step of increasing said clearance.

20. A method in accordance with claim 18, wherein said step of forming an inner conductor on said inner peripheral surface includes extending said inner conductor onto one end surface.

21. A method in accordance with claim 20, wherein said step of adjusting said clearance includes a step of increasing said clearance.

22. A method of adjusting to a prescribed value the resonance frequency of a high frequency coaxial resonator, comprising the steps of:

preparing a dielectric member having a tubular cross-section and having a through hole along its central axis and comprising inner and outer peripheral surfaces and a pair of end surfaces opposite each other along the axial direction;

forming an inner conductor on said inner peripheral surface;

forming an outer conductor on said outer peripheral surface;

said tubular dielectric member with said inner and outer conductors initially having a resonance frequency above the prescribed value;

extending said outer conductor from said outer peripheral surface onto at least one of said end surfaces and defining a clearance between an end portion of said inner conductor and said outer conductor, said clearance forming a capacitance between said end portion of said inner conductor and said outer conductor extending onto said at least one end surface, and thereby reducing the resonance frequency of said coaxial resonator below the prescribed value, and thereafter adjusting the clearance to obtain a resonance frequency of the prescribed value.

23. The method in accordance with claim 22, wherein said step of adjusting said clearance includes a step of increasing said clearance.

24. The method in accordance with claim 23, wherein said step of adjusting said clearance comprises providing an angular cut at least through said end portion of said inner conductor.

25. The method in accordance with claim 24, wherein said step of adjusting said clearance comprises the step of providing said angular cut through said dielectric member and said end portion of said inner conductor.

26. The method in accordance with claim 25 wherein said step of adjusting said clearance further comprises the step of providing said angular cut through said outer conductor extended onto said at least one end surface.

27. The method in accordance with claim 22, further comprising reducing the length of said tubular dielectric member to increase the resonance frequency, and thereafter performing said step of defining a clearance to reduce the resonance frequency.

* * * * *